United States Patent [19]

Malagnoux

[11] Patent Number: 4,625,538

[45] Date of Patent: Dec. 2, 1986

[54] PLUG GRIP FOR FITTING EXPANSION PLUGS

[75] Inventor: Roger Malagnoux, St Brice Sous Foret, France

[73] Assignee: Etablissements Pierre Grehal et Compagnie, St. Brice Sous Foret, France

[21] Appl. No.: 712,010

[22] Filed: Mar. 15, 1985

[30] Foreign Application Priority Data

Mar. 29, 1984 [FR] France ..... 84 04927

[51] Int. Cl.[4] ..... B21D 9/05

[52] U.S. Cl. ..... 72/391

[58] Field of Search ..... 29/268, 283.5; 72/391; 254/129, 130, 18, 21, 22; 81/315, 316, 427.5

[56] References Cited

U.S. PATENT DOCUMENTS

| | | | |
|---|---|---|---|
| 2,329,562 | 9/1943 | Stensrud | 254/22 |
| 2,530,215 | 11/1950 | Zidar | 81/427.5 |
| 3,324,700 | 6/1967 | Elliott | 72/391 |

*Primary Examiner*—Robert C. Watson

*Attorney, Agent, or Firm*—Browdy & Neimark

[57] ABSTRACT

The plug grip comprises a first and a second arms pivotally mounted together, with the first arm leading to a bearing shoe member and the second arm causing a raise of a screw of an expansion plug. The second arm comprises two successive bearing points, a first bearing point providing a great lever arm ratio for causing a start of bending of the expansion plug and a second bearing point providing a smaller lever arms ratio for increasing a distortion stroke of the expansion plug.

14 Claims, 14 Drawing Figures

21
2
1
20
3
5
9
16
14
15a
15
f
15b
29
26a
28
26
12
11
22a
22
13
18
19
23
33
25
24
30
31
32

Fig: 6
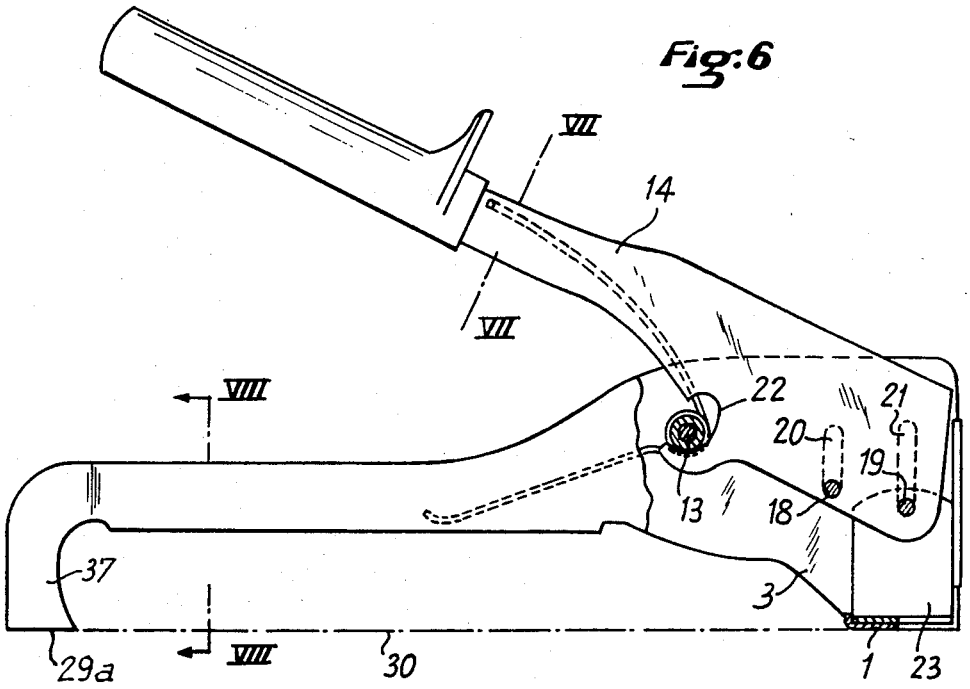
Fig: 7
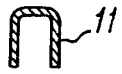
Fig: 8
Fig: 13
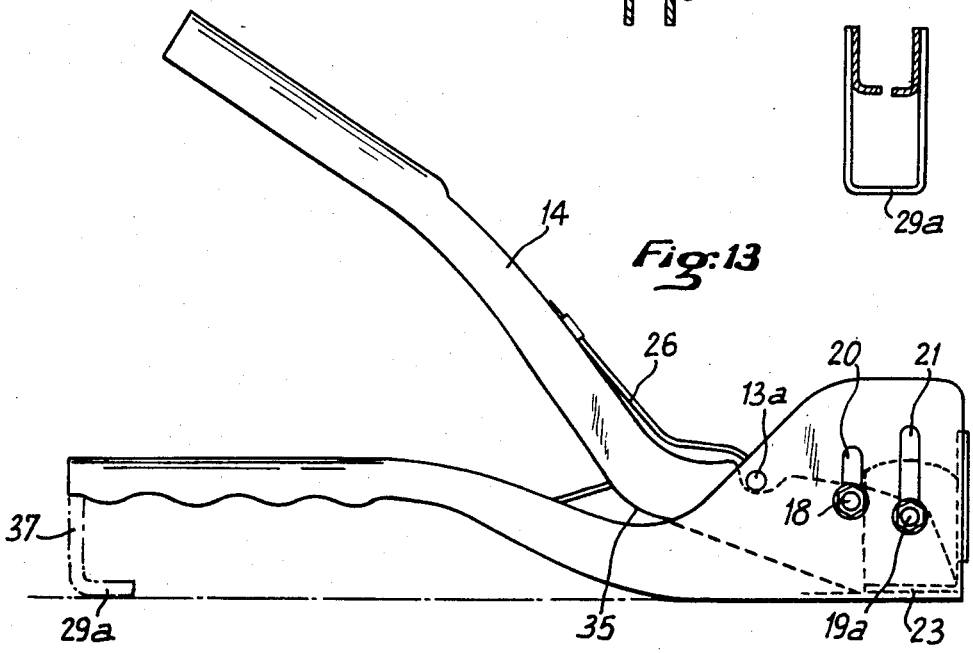

13a
22₁
19a
1a
35

19a
13a
22₁
1a
34
3a
35

14
10
13a
21a
22₁
36
21
34
19a
1a
35
3a
26

36
21
19a
13
26

PLUG GRIP FOR FITTING EXPANSION PLUGS

FIELD OF THE INVENTION

The present invention relates to a new plug grip for fitting expansion plugs. Metal expansion plugs are more and more used in the building art since they permit to realize strong fixations in fragile or crumbly plates or walls, and typically in panels made of plaster and platics foam composite, in walls made of hollow bricks, in hollow bulkheads, as well as in other materials in which it is compulsory to distribute stresses applied thereto.

BACKGROUND OF THE INVENTION

Expansion plugs which are commercially found comprise generally two sockets connected together by means of longitudinal elements which must be caused to bend rearwardly of the front surface of the panel supporting the plug.

The initial distortion for starting to bend the plug necessitates to apply to the plug a very great force while the ulterior bending of the plug does not necessitate a great force but implies an important working stroke.

The invention solves the hereinbefore described problem by creating a new plug grip which enables, for fitting expansion plugs, to first exert a very important force, and then a force which is substantially smaller but has a long stroke, which permits an expansion of wall plugs in a simple, safe and rapid manner.

INFORMATION DISCLOSURE STATEMENT

French Patent No. 2,343,564 to Brendle has shown a plug grip having one arm bearing on the top portion of a plug, while a pivotally mounted tumbler articulated to this arm bears under the head of the plug and is controlled by a lever which is itself bearing on the arm.

U.S. Pat. No. 3,831,424 to James describes a blindriveting pliers tool having an intermediate member pivoted by an operating handle to act on a jaw case in tensioning a mandrel. The arrangement is such that as the tool is operated by pulling the handle away from the workpiece which is to receive the rivet, mechanical advantage increases and there is a reduced tendency for the tool to "jump" when the stern of the mandrel breaks.

French Patent No. 2,354,853 to Futters describes a tool for expansion of plugs, this tool comprising two levers which are pivotally connected together for acting on a sliding member which exerts a pulling action on the head of a screw provided in the plug.

OBJECT OF THE INVENTION

The invention provides a plug grip which is simple to manufacture and very convenient. The plug grip does not risk to damage the plug when the plug is expanded and does not risk to damage the screw which must be screwed and unscrewed as many times as necessary after positioning the plug.

SUMMARY OF THE INVENTION

According to the invention, the plug grip for fitting expansion plugs comprises a first and a second arms, said first and second arms being pivotally mounted together, with the first arm leading to a bearing shoe member and the second arm causing a screw of an expansion plug to raise, said second arm comprising two successive bearing points, a first one of the bearing points providing a great lever arm ratio for causing a start of bending of the expansion plug while a second bearing point of the two bearing points provides a smaller lever arm ratio for increasing a distortion stroke of the expansion plug.

Various other features of the invention will moreover be revealed from the following detailed disclosure.

BRIEF DESCRIPTION OF THE DRAWINGS

Embodiments of the invention are shown as nonlimitative examples in the accompanying drawings, in which:

FIG. 6 is an elevation view partly in cross section of a first variant of embodiment;

FIG. 7 is a cross-section taken along line VII—VII of FIG. 6;

FIG. 8 is a cross-section taken along line VIII—VIII of FIG. 6;

FIG. 13 is an elevation view of another variant of embodiment.

DESCRIPTION OF THE PREFERRED EMBODIMENTS

The plug grip of FIGS. 1–5 comprises a flat shoe member 1 in which is made a notch 2 having preferably a slight V-shape typically opening frontwardly.

Figures 1, 2:
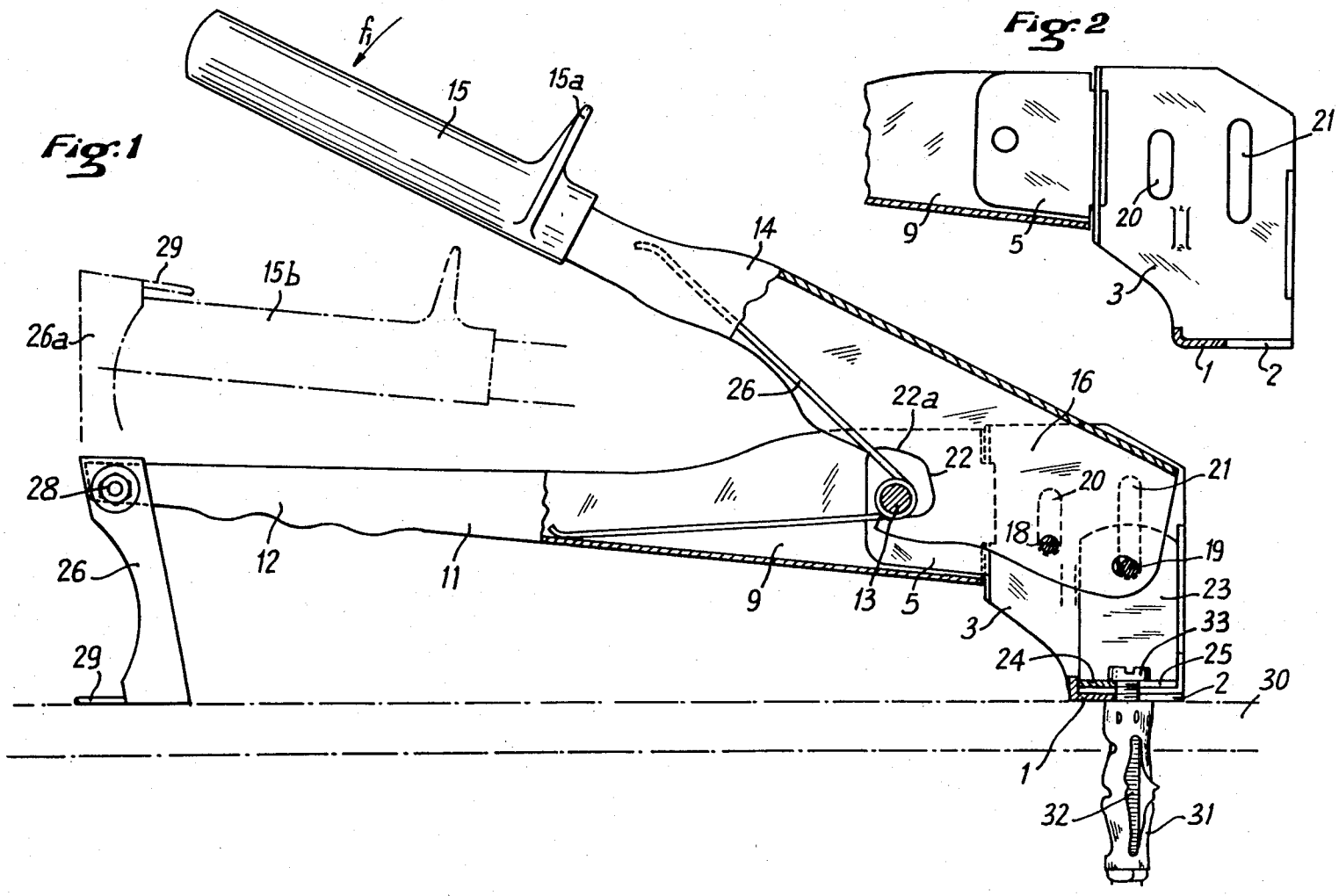
FIG. 1 is a side-elevation view partly in cross section of the plug grip according to the invention.
FIG. 2 is a partial cross section of a detail of embodiment of the plug grip of FIG. 1.
Figures 3, 4, 5:
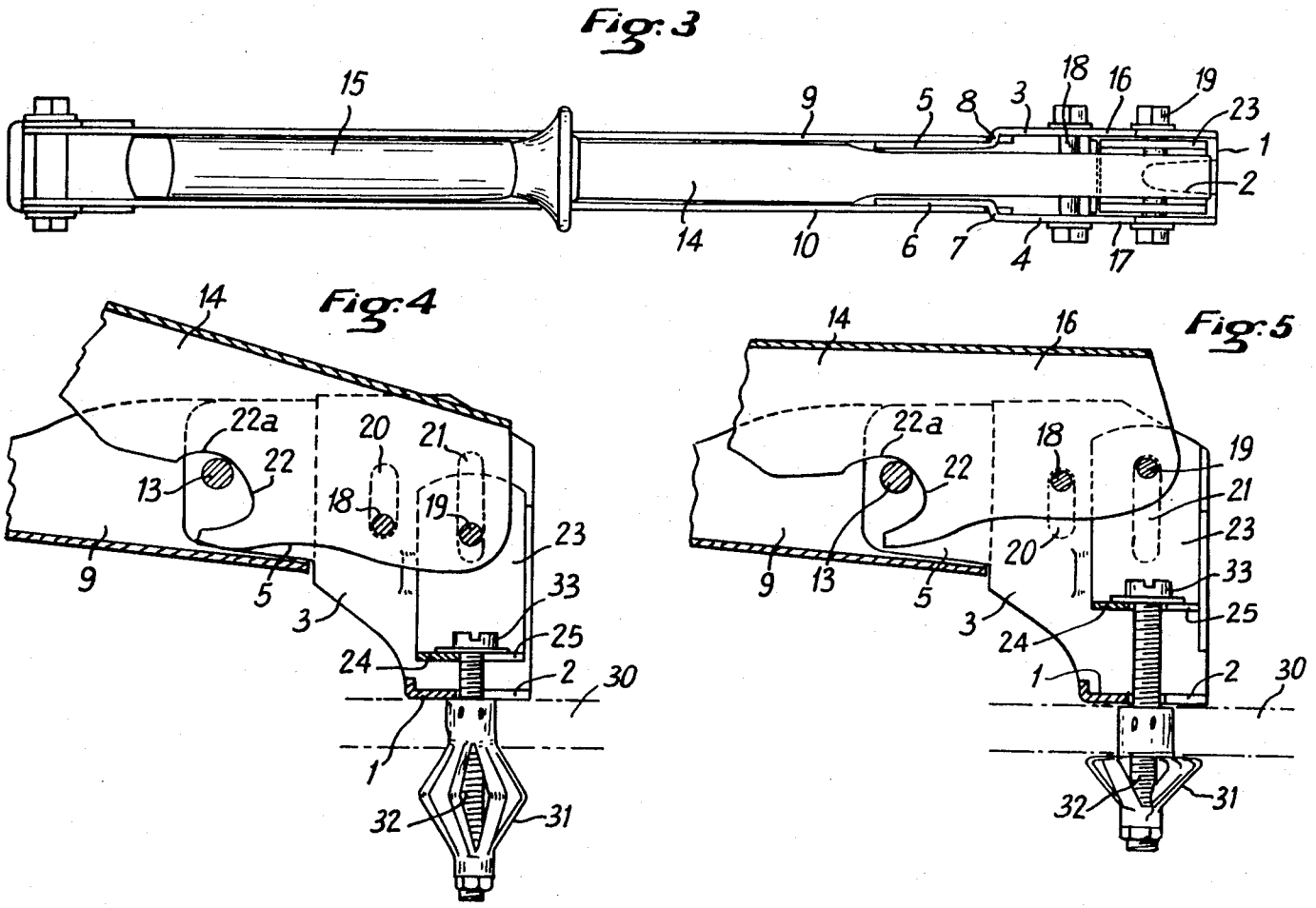
FIG. 3 is a top view of the plug grip of FIG. 1.
FIG. 4 is a partial cross-section of the plug grip of FIG. 1 and shows a characteristic working position.
FIG. 5 is a cross-section similar to FIG. 4 and shows another characteristic working position.

The shoe member 1 connects two flanges 3, 4 extended by wings 5, 6 (FIG. 3). The wings 5, 6 form with the flanges 3, 4 two shoulders 7, 8 against which abut sides 9, 10 of an arm 11 formed by a U-shaped member preferably provided with corrugations 12 near its rear part, as shown at the left side of FIG. 1.

The wings 5, 6 of the flanges 3, 4 are maintained between the sides 9, 10 of the arm 11 by means of a spindle 13.

The plug grip comprises a second arm 14 having also a U-shape, which arm 14 forms or comprises a handle 15 at its rear part. The second arm 14 is engaged by its front end between the flanges 3, 4, and it has lateral sides 16,17 for supporting spindles 18, 19. The spindles 18, 19 cross through elongated apertures 20, 21 which are made in the flanges 3, 4. The apertures 21 have a length which is greater than that of the apertures 20.

The drawings show also that the lateral sides 16, 17 of the second arm 14 form a notch 22 having a width which is substantially greater than the diameter of the spindle 13.

The spindle 19 which is passed through the apertures 21 supportsa stirrup member 23 engaged between the flanges 3, 4 and having a bottom portion 24 in which is made a notch 25 coinciding with the notch 2 of the shoe 1.

A pin-shaped spring 26 is wound on the spindle 13 and has, by its two legs, a tendency to separate the arms 11, 14 in order to maintain the bottom 24 of the stirrup member 23 against the top portion of the shoe 1.

The hereinabove described embodiment permits to manufacture the bottom portion 24 as well as the flanges 3, 4 and their wings 5, 6 a very from strong metal, typically treated steel, while the arms 11, 14 may be made more economically of soft iron or other metal.

The handle 15 can be a metal handle, or can preferably be made by a sheath of plastic material forming an abutment 15*a*. Although this is not compulsory, it is however particularly advantageous, as shown in FIG. 1, to provide a pivoting prop 6 forming a lock and which is articulated on a spindle 28 crossing through the arm 11 at its rear end.

The prop 26 is provided with a shoe member 29, and the length of the prop 26 is chosen so that the shoe member 29 will be in the same plane than the shoe member 1 when the prop 11 is made to pivot into the position shown in full line in FIG. 1.

When the prop is pivoted in the position shown in phantom at 26*a*, the shoe member 29 is used as a lock for the handle 15 of the second arm 14 when the second arm 14 is pivoted into the corresponding position which is the un-use position of the plug grip.

In order to facilitate understanding of how the plug grip can work, the drawings show a plate 30 behind which will be distorted an expansion plug 31 containing a screw 32, for providing first expansion of the plug 31 and then a fixation of any article on the plate 30.

In the position shown in FIG. 1, the screw 32 slightly protrudes from the plate 30, and it is possible to bring it in the bottom of the notches 2 and 25, the bottom portion 24 of the stirrup member 23 bearing then under the head 33 of the screw. In this position, the spindles 18 and 19 carried by the second arm 14 are in the bottom of the apertures 20, 21, and the spindle 13 is maintained in bottom portion of the notch 22 by means of the pin-shaped spring 26.

The drawings also show that the arm 11 is maintained by the lock 26 in a position for which the shoe member 1 is applied flat on top of the plate 30.

By acting on the handle 15 in direction of the arrow $f_1$, the spindle 18 bears on the bottom of the apertures 20 by thus forming a first pivoting axis for the second arm 14. The distance between the spindle 18 and the spindle 19 being a small distance, the second arm 14 forms a lever having a great lever arm ratio and consequently the force exerted on the handle 15 is very much enlarged. This force has for its effect to raise the spindle 19 which drives the stirrup member 23 while bending the expansion plug 31 which is progressively distorted as shown in FIG. 4.

When the second arm 14 is sufficiently pivoted, the upper part 22*a* of the notch 22 comes on the spindle 13. By still exerting on the second arm 14 a force in direction of the arrow $f_1$, the pivot axis of the second arm 14 is moved for coming at a level of the spindle 13 since the second arm will then abut against the spindle 13. The distance between the spindle 13 and the spindle 19 being greater than distance between the spindles 18 and 19 the lever arm ratio is modified relatively to what it was previously for becoming smaller, but it results therefrom an increase of the stroke of the pin 19 for a same pivoting angle of the second arm 14 which permits to greatly distort the expansion plug 31 as shown in FIG. 5.

It results from the preceding disclosure that in a first working step, the lever arm ratio being important, there is exerted a force which is also important and produces a small stroke distortion of the expansion plug, then in a second working step the lever arm ratio decreases and the distortion amount of the expansion plug increases proportionally, without the force to be exerted on the handle 15 being substantially modified. Actually, the plug 31 is first working on compression, and the plug 31 is then working substantially only on bending as soon as the first bending force which is applied to the plug 31 has caused its first distortion.

FIG. 6 shows a variant of embodiment according to which the flanges 3, 4 and the shoe member 1 are directly formed by the first arm 11 which is made for example of steel by cutting and stamping a metal plate, the shoe member 1 and a further shoe member 29*a* providing a link between the sides 9, 10 and the flanges 3, 4 previously described.

As in the example of FIGS. 1 to 5, the second arm 14 controls the stirrup member 23 through the spindles 18 and 19 as well as the spindle 13. This embodiment is of a low cost since it is easy to manufacture.

An analogous result is obtained since the first arm 11 can be applied on the plate 30 through the shoe members 1 and 29*a*.

FIGS. 9–12 show a variant of embodiment according to which the first arm 10 is made by a U-bent iron and forms flanges 3*a* at its anterior part, the flanges 3*a* protruding from a flat shoe member 1*a*. The flanges 3*a* support a spindle 13*a* on which is wound the pin-shaped spring 26 which, as in the preceding examples, has a tendency to separate the first arm 10 from the second arm 14 which, in this embodiment, forms an upwardly directed notch $22_1$.

The second arm 14 carries a spindle 19*a* which is moved in the apertures 21*a* of the flanges 3*a* of the first arm 10. The second arm 14 is also manufactured from a U-bent iron plate and this iron plate is shaped at its front part to have its bottom part provided with two arcuate portions 34 and 35, the arcuate portion 34 being placed between the spindle 19*a* and the spindle 13*a*, while the arcuate portion 35 is placed beyound the spindle 13*a* relatively to the end of the first and second arms 10, 14 which arms have notches $2_1$ and 36 coinciding together.

Figures 9, 10, 11, 12:
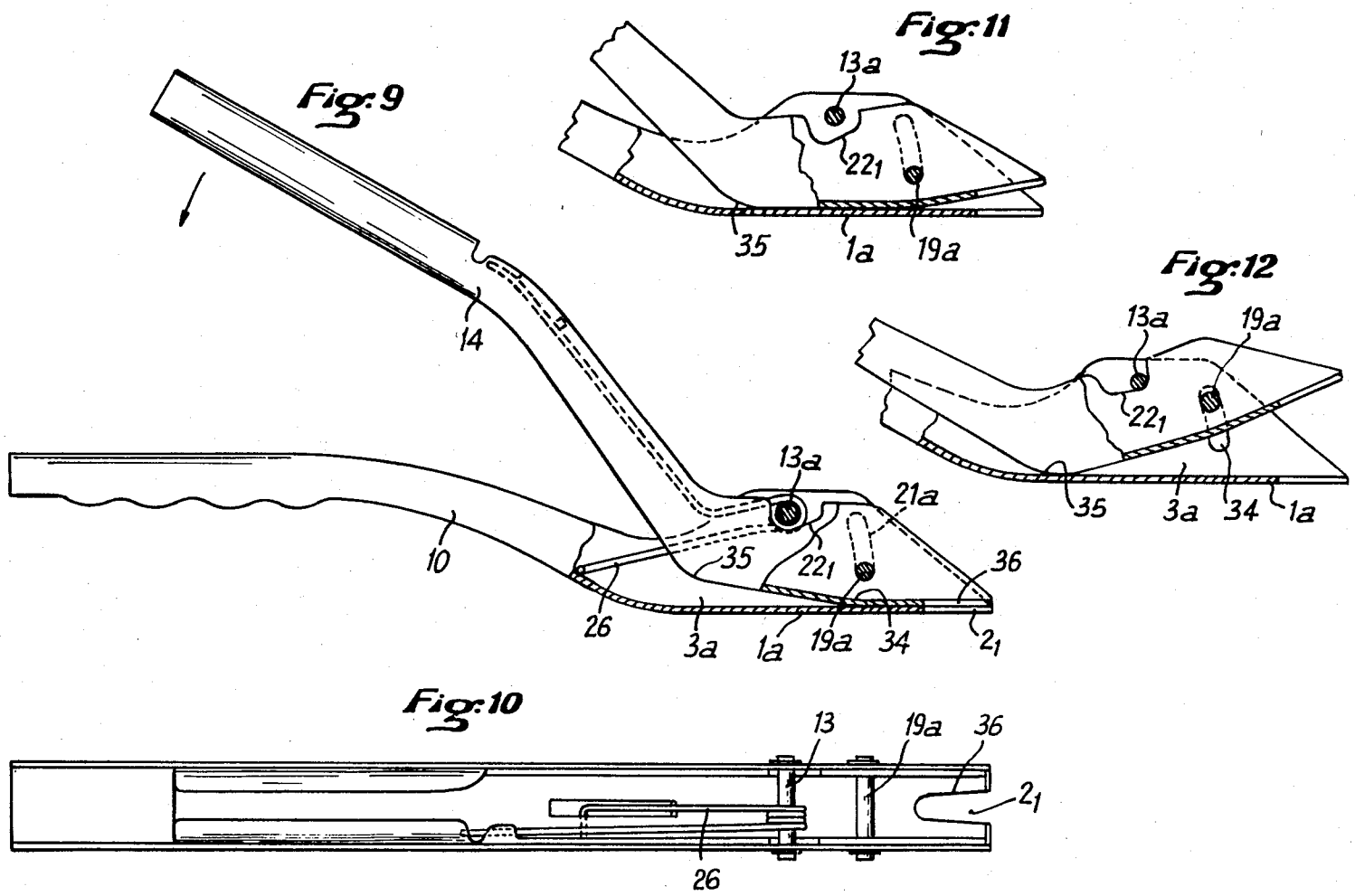
FIGS. 9 and 9*a* are elevation views partly in cross-section of a second variant of embodiment according to two realizations.
FIG. 10 is a top view of the variant of embodiment of FIG. 9.
FIGS. 11 and 12 are partial elevational cross-sectional views showing two characteristic working positions.

As previously, when the plug grip is in the position shown in FIG. 9, the plug grip is engaged by means of the notches $2_1$ and 36 beneath the head of a screw then the two arms 10 and 14 are brought together while maintaining the shoe member 1*a* flat on the bearing plate from which is protruding the screw of the expansion plug.

Upon pivoting the second arm 14 relatively to the first arm 10, the second arm pivots first around the arcuate portion 34, the lever arm ratio being then very great as above described, which permits to start bending the expansion plug. During this first pivot movement, the pin 19*a* is moved in the apertures 21*a*.

When the second arm has sufficiently pivoted, it bears on the top of the first arm through the second arcuate portion 35, which decreases the lever arm ratio (see FIGS. 11 and 12) but increases the stroke of the spindle 19*a* and therefore the measure of distortion of the expansion plug.

The result is therefore similar to what is described in the preceding disclosure by reference to FIGS. 1 to 5.

Figure 9A:
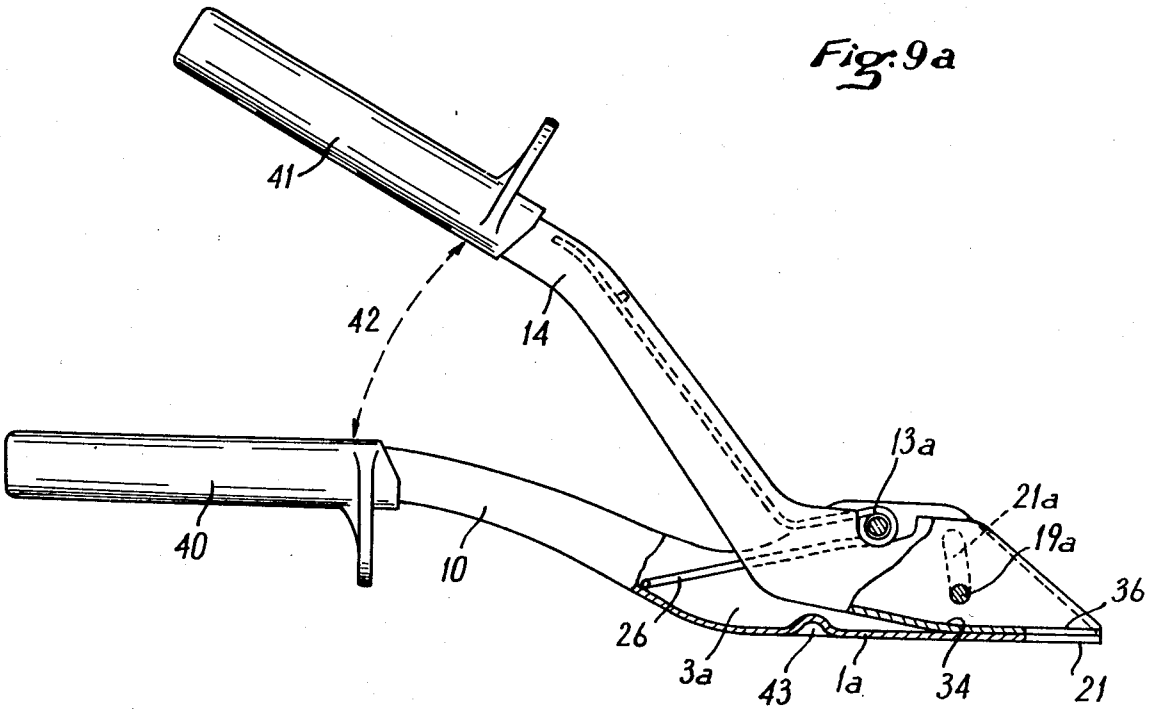

FIGS. 9*a* shows a development of the invention according to which the first and second arms 10 and 14 are provided with handles 40, 41 made of a relatively flexible material, for example plastic material, which forms an overthickness and consequently reduces the space 42 between the two handles 40 and 41. The space 42 being not able to be increased for permitting a grip of the handles by only one hand of the user, and the useful stroke of the plug grip being not possibly reduced, a boss 43 is formed in the first arm 10, the boss 43 facing the second arm. Therefore, after a start of bending of the plug upon pivoting the second arm 14 around the arcuate portion 34, the second arm 14 comes to bear on the boss 43, which increases the useful stroke of the plug grip. Although this is not shown, a same result would be obtained by forming the boss 43 in the second arm 14, the boss 43 then facing the first arm 10.

FIG. 13 shows a variant of embodiment in which the arrangement is similar to that above described in reference to FIGS. 9–12.

However in the embodiment of FIG. 13, the spindle 19a is provided with a stirrup member 23 similar to that of the embodiment of FIGS. 1–5, and the second arm 14 is also provided with a spindle 18 similar to that of FIGS. 1–5. In this case, the second arm 14 comprises only the arcuate portion 35 which forms the second bearing point for causing a great stroke, as described above in reference to FIGS. 9–12, the first bearing point which causes the start of bending of the plug being provided by the spindle 18, exactly as described above in reference in FIGS. 1–5.
with a prop and a bearing shoe member 29*a*, as in the embodiment of FIG. 6. The bearing shoe member 29*a* formed from the fixed prop 37 can obviously be pivotally mounted if desired in the same manner as shown in FIG. 1.

I claim:

1. A plug grip for fitting expansion plugs comprises a first and a second arms, said first and second arms being pivotally mounted together, with the first arm leading to a bearing show member and the second arm causing a raise of a screw of an expansion plug, said second arm comprising two successive bearing points, a first one of the bearing points providing a great lever arm ratio for causing a start of bending of the expansion plug while a second bearing point of the two bearing points proivdes a smaller lever arm ratio for increasing a distortion stroke of the expansion plug, and wherein the first arm comprises a first shoe member and a second shoe member which are in a same plane for preventing a pivoting movement of said first arm during a pivoting movement of said second arm.

2. The plug grip as set forth in claim 1, wherein the first bearing point is formed by a spindle carried by the second arm and guided in an aperture provided in the first arm.

3. A plug grip for fitting expansion plugs comprises a first and a second arms, said first and second arms being pivotally mounted together, with the first arm leading to a bearing shoe member and the second arm causing a raise of a screw of an expansion plug, said second arm comprising two successive bearing points, a first one of the bearing points providing a great lever arm ratio for causing a start of bending of the expansion plug while a second bearing point of the two bearing points provides a smaller lever arm ratio for increasing a distortion stroke of the expansion plug, and comprising further a spindle for a pin-shaped spring tending to separate said first and seoond arms, the spindle being carried by the first arm facing a notch of the second arm.

4. The plug grip as set forth in claim 3, wherein the second bearing point of the second arm is formed by the spindle on which is wound the pin-shaped spring.

5. A plug for fitting expansion plugs comprises a first and a second arms, said first and second arms being pivotally mounted together, with the first arm leading to a bearing shoe member and the second arm causing a raise of a screw of an expansion plug, said second arm comprising two successive bearing points, a first one of the bearing points providing a great lever arm ratio for causing a start of bending of the expansion plug while a second bearing point of the two bearing points provides a smaller lever arm ratio for increasing a distortion stroke of the expansion plug, and wherein the second arm carries a spindle guided in apertures of the first arm and to which is hanged a stirrup member having a bottom portion extending parallel to the shoe member and having a notch coinciding with a notch provided in said shoe member.

6. The plug grip of claim 1 wherein said first arm has a distal end with an articulated part provided as a bearing member for preventing a pivoting movement of the first shoe member.

7. The plug grip as set forth in claim 6, and wherein said articulated part has a protruding portion provided to rest on top of the second arm at a rest portion of the plug grip.

8. The plug grip as set forth in claim 1, and wherein the first and second arms are both made of metal sheets, said metal sheets being cut and bent for having a U-shape in cross-section, said first and second arms being respectively engageable together.

9. The plug grip as set forth in claim 3, and wherein said first arm has a distal end with an articulated part provided as a bearing member for preventing a pivoting movement of the first shoe member.

10. The plug grip as set forth in claim 9, and wherein said articulated part has a protruding portion provided to rest on top of the second arm at a rest position of the plug grip.

11. The plug grip as set forth in claim 3, and wherein the first and second arms are both made of metal sheets, said metal sheets being cut and bent for having a U-shape in cross-section, said first and second arms being respectively engageable together.

12. The plug grip as set forth in claim 5, and wherein said first arm has a distal end with an articulated part provided as a bearing member for preventing a pivoting movement of the first shoe member.

13. The plug grip as set forth in claim 12, and wherein said articulated part has a protruding portion provided to rest on top of the second arm at a rest position of the plug grip.

14. The plug grip as set forth in claim 5, and wherein the first and second arms are both made of metal sheets, said metal sheets being cut and bent for having a U-shape in cross-section, said first and second arms being respectively engageable together.

* * * * *

UNITED STATES PATENT AND TRADEMARK OFFICE

CERTIFICATE OF CORRECTION

PATENT NO. : 4,625,538

DATED : December 2, 1986

INVENTOR(S) : Roger MALAGNOUX

It is certified that error appears in the above—identified patent and that said Letters Patent is hereby corrected as shown below:

Col. 3, line 7: change "a very from strong" to read --from a very strong--;

line 19: change "than" to read --as--;

Col. 5, line 30: Insert --Fig. 13, shows that the first arm 10 can be provided-- at the beginning of the line.

line 39: change "show" to read --shoe--;

line 44: change "proivdes" to read --provides--;

Col. 6, line 3: change "seoond" to read --second--.

Signed and Sealed this

Thirty-first Day of January, 1989

*Attest:*

DONALD J. QUIGG

*Attesting Officer*

*Commissioner of Patents and Trademarks*